US005129966A

United States Patent [19]

Rao

[11] Patent Number: 5,129,966

[45] Date of Patent: Jul. 14, 1992

[54] HIGH PERFORMANCE HIGH STRENGTH LOW ALLOY CAST STEELS

[76] Inventor: Bangaru V. N. Rao, 5 Revere Ct., Annandale, N.J. 08801

[21] Appl. No.: 625,844

[22] Filed: Dec. 11, 1990

Related U.S. Application Data

[63] Continuation-in-part of Ser. No. 533,574, Jun. 5, 1990, abandoned.

[51] Int. Cl.[5] ..... C22C 38/00

[52] U.S. Cl. ..... 148/143; 148/12.1; 148/12 R; 148/134; 420/89; 420/91; 420/111

[58] Field of Search ..... 148/143, 12 R, 12.1, 148/134; 420/91, 89, 111

[56] References Cited

U.S. PATENT DOCUMENTS 3,110,798 11/1963 Keay et al. ..... 420/91

3,368,887 2/1968 Enis et al. ..... 420/91

3,787,201 1/1974 Matsukura et al. ..... 420/90

4,043,807 8/1977 Kirman ..... 420/91

*Primary Examiner*—Upendra Roy

*Attorney, Agent, or Firm*—Mathews, Woodbridge & Collins

[57] ABSTRACT

A high strength, low alloy, low to medium carbon steel casting is provided of the Fe/Cr/C type containing by weight about 0.1 to 0.5% Si, said steel characterized by the presence of a small but effective amount of each of Cu and Ni sufficient to enhance the mechanical stability of retained austenite formed following quenching of said steel from its austenitizing temperature, the amount of Ni being at least sufficient to counteract the destabilizing effect of Si on austenite. Preferably the steel also includes small but effective amounts of Al, Ti and Nb sufficient to provide a fine grained microstructure.

6 Claims, 1 Drawing Sheet

HIGH PERFORMANCE HIGH STRENGTH LOW ALLOY CAST STEELS

This application is a continuation-in-part of U.S. application Ser. No. 533,574, filed Jun. 5, 1990, abandoned, the subject matter of which is incorporated herein by reference.

BACKGROUND OF THE INVENTION

The present invention relates to a class of high performance, high strength, low alloy, low to medium carbon steel for castings; whereas, the above-identified U.S. application Ser. No. 533,574 is directed to high performance wrought steels.

STATE OF THE ART

High strength, low alloy, low to medium carbon cast steels are of particular interest because of their wide variety of uses. Where these steels combine high hardness with high toughness, they find special application in military (ordnance) applications including armor castings (commander's work station castings, etc.), muzzle brake castings, light weight retrofit armor and slotted retrofit armor; and also in mining and comminution industries, including track shoes, hoist drums, ball mill feed end heads, boom clevis castings, sprockets, drag chain and ring gears for ball mills. Other uses include automotive trucks, construction machinery, as well as structural applications including, for example, fifth wheels, suspension components, trailer hitches, axle housings, front dipper bucket components and teeth, hitch housings, yokes, etc., for road building equipment, bridge shoes and saddles, pile driving machinery (pile followers), and off-highway truck components (transmission housings, torque tubes). The steels also have use on railroads for lighter draft gear, sideframes, bolsters, motor truck frames, and draft gear for municipal light rail applications Where such steel castings combine moderate hardness/strength with excellent weldability, they can be used for nodes for offshore oil/gas drilling/production platforms. Where such castings combine high wear/abrasion resistance with excellent corrosion and impact strength, they can be used for sugar cutting knives and tool and die steel castings. Where such castings combine moderate strength with high corrosion resistance in sour environments, they find special application in sour service including valve and stem and stem castings in oil/gas production and transport.

Cast steels in practice are not only subject to load bearing but also are exposed to various environments, often aggressive, and as such are required to possess good environmental resistance; and good load bearing capacity under the simultaneous action of load and environment for a variety of environmental conditions. Unfortunately, however, even those few high strength steels which have been designed based on a sound scientific basis have addressed either the mechanical properties or the environmental properties but were rarely designed to optimize both of these essential parameters for optimum engineering performance. Thus, many of the state-of-the-art cast steels which exhibit superior combination of strength and toughness are susceptible to stress corrosion cracking and hydrogen induced cracking.

From a practical point of view, cast steels must be designed to confer some flexibility for processing under a variety of steel foundry conditions, for example, the ability to develop the desired microstructure and properties under a variety of foundry shop conditions. For example, the steel should be weldable under a variety of welding conditions and it should have excellent weld heat-affected-zone (HAZ) toughness. These complex and varied requirements for a truly outstanding high strength low alloy cast steel for the modern world requires an integrated design approach based on a sound scientific and technical basis. The input for such an approach should include as many practical considerations and requirements as possible, such as weld HAZ toughness, as well as resistance to stress corrosion cracking and to hydrogen induced cracking.

The importance of designing structural steels having high strength and toughness is described in a paper directed to wrought steels entitled "Structure-Property Relations And The Design Of Fe-4Cr-C Base Structural Steels For High Strength And Toughness" by Rao and Thomas which appears in *Metallurgical Transactions A*, Volume 11A, 1980, pp. 441–457.

In this paper some design guidelines are given for improving strength-toughness combinations in medium carbon structural steels of the Fe/Cr/C type by employing Mn and/or Ni additions. These additions were used to promote improvement in toughness properties due to the formation of retained austenite and due the fact that the addition of Ni and/or Mn tended to improve the thermal stabilization of austenite.

U.S. Pat. Nos. 4,170,497 and 4,170,499 issued to the aforementioned authors describe a structural steel with superior strength-toughness combinations. This steel is based on developing a composite microstructure of dislocated, auto-tempered lath martensite surrounded by films of untransformed austenite, that is, retained austenite. While these patents describe in broad terms the desirable microstructural features from a purely mechanical property point of view, the optimization of these microstructural features for the best combination of mechanical properties is not considered. Most importantly, other practical requirements including the environmental resistance aspects (such as stress corrosion cracking resistance (SCC), and hydrogen induced cracking resistance) are not considered. These patents describe high strength, tough alloy steels consisting essentially of from about 0.20 to about 0.35 weight % carbon, about 3.0 to 4.5 weight % chromium, and at least 1 weight % of at least one other substitutional alloying element selected from the group consisting of nickel, manganese, molybdenum, cobalt, silicon, aluminum and mixtures thereof, and the remainder iron. These patents also describe complex double heat-treatments to produce grain refining and the desired microstructure within these grains.

It would be desirable to provide a low alloy, low to medium carbon cast steel of the Fe/Cr/C variety containing a novel combination of alloying constituents capable of optimizing the microstructural characteristics of the steel without requiring the use of complex heat treatments.

OBJECTS OF THE INVENTION

It is thus an object of the invention to provide a low alloy, low to medium carbon cast steel composition of the Fe/Cr/C type containing a novel combination of alloying constituents and characterized by optimum combination of mechanical properties in the cast and heat treated state.

Another object of the invention is to provide a low alloy, low to medium carbon cast steel of the Fe/Cr/C type containing a novel combination of alloying constituents sufficient to enhance the mechanical stability of retained austenite formed in said steel.

A further object of the invention is to provide as an article of manufacture a heat treated cast steel of the Fe/Cr/C type characterized by a hardness of at least about 20 $R_c$, a fine grained microstructure consisting essentially of lath martensite enveloped by a thin film of retained austenite, said austenite being further characterized by enhanced mechanical stability.

A still further object of the invention is to provide a low alloy, low to medium carbon cast steel composition of the Fe/Cr/C type containing about 0.1 to 0.5% Si, preferably, about 0.2 to 0.4% Si together with controlled amounts of carbon, nickel, copper, niobium, titanium and aluminum, said cast steel composition characterized in the heat treated state by optimum hardness, optimum combination of mechanical properties, and thermally stable retained austenite and fine grain size.

These and other objects, features and advantages will become more apparent when considered in conjunction with the accompanying disclosure, claims, and appended drawings.

THE DRAWING

FIG. 1 is a plot illustrating critical flaw size versus service stress for various fracture toughness levels indicated on each curve based on simple linear elastic fracture mechanics; and FIG. 2 is a schematic of an idealized microstructure of the steel showing equiaxed grains at about 200 times magnification and the microcomposite microstructure within an equiaxed grain showing layers of rows of retained austenite disposed between lath martensite as viewed with an electron microscope at about 60,000 time magnification.

Generally speaking, commercial high/ultra-high strength steels offer good hardness/strength or toughness but rarely a combination of both. This is especially true for steels in the hardness range HRc 42-50 (BHN 400-500) wherein the toughness properties, both the sharp notch plane strain fracture toughness, KIc and the blunt notch Charpy impact toughness, are generally very poor. This is an especially serious limitation for cast grades. For example, the widely used ultra-high strength wrought steel, AISI/SAR 4340 is characterized at ambient by only 10 to 15 ft-lbs Charpy-V-Notch (CVN) impact toughness and only about 40 to 50 ksi-in$^{\frac{1}{2}}$ plane strain fracture toughness at ambient when the steel is heat-treated in the range 440-500 BHN. For cast grade, these properties are even lower and the wrought properties can be considered as upper limit for such castings. These toughness properties are much below those needed to fully exploit the steel's available strength for many structural applications wherein fracture mechanics based design is used.

This is particularly illustrated in FIG. 1 which shows a plot of critical flaw size versus service stress for various fracture toughness levels as indicated on each curve based on simple linear elastic fracture mechanics. Experimental limitations make the detection of tiny cracks extremely difficult and about 0.1 inch is generally considered to be the limit for detection by conventional methods. Ultra-high strength steels, due to their low toughness to strength ratio, have extremely small critical flaw sizes for catastrophic failure. Quite simply, FIG. 1 defines the acceptable service stresses for assumed flaw size detectability limits.

For example, for a flaw size detectability limit of 0.1" and a safety factor of one, to prevent catastrophic fracture in service for AISI 4340 steel, service stress has to be limited to less than about 50 ksi which is less than about 25% of the yield strength of the steel The allowable service stress quickly increases to about 130 ksi with doubling of fractures toughness to 80 ksi-in$^{\frac{1}{2}}$. Even at this level, the full strength of 4340 (yield strength in the range 200-230 ksi) will not be utilized. In order to fully utilize the available strength for design, steels in the strength range under discussion should have fracture toughnesses in excess of 100 ksi-in$^{\frac{1}{2}}$. The present cast steels have been developed to fulfill this need.

There are important differences between wrought and cast grades of steels and the alloy design to produce the desired superior properties and these differences have to be addressed. First, articles of use are formed or fabricated from the wrought grades. Thus, the wrought steel is mechanically worked in this process starting from an initially large ingot. However, in the case of castings, the object is cast near net shape and is not subject to further mechanical work as a means to shape the article, except for some minor machining. Thus, the desired microstructure disclosed in the co-pending parent application has to be established in a casting without depending on the mechanical part of the thermomechanical processing, in other words, the desired microstructure in a casting can only be established through thermal (heat-treatment) processing once the chemistry is chosen. Furthermore, since castings are not subject to further mechanical working as is the case with wrought products, it is important that the castings have good quality (soundness) and free from defects and shrinkage, both macro and micro, in order to ensure that the casting soundness will not be limiting to its performance. For these reasons, modifications to the chemistry and heat-processing have been implemented to obtain superior casting steels in the present invention.

STATEMENT OF THE INVENTION

One embodiment of the invention resides in a method for enhancing the mechanical stability of retained austenite of high strength, low alloy, low to medium carbon steel castings of the Fe/Cr/C type containing about 0.1 to 0.5% Si, e.g. about 0.2 to 0.4% Si, said method comprising adding a small but effective amount of both copper and nickel to said steel composition, the amount of nickel being at least sufficient to counteract the destabilizing effect of Si on austenite.

Another embodiment of the invention is directed to a high strength, low alloy, low to medium carbon steel casting of the aforementioned Fe/Cr/C low alloy steel.

Such cast steels include, in addition to the aforementioned amount of Si, about 0.5 to 4% Cr, about 0.05-0.5% C, small but effective amounts of about 0.1 to 2% Cu and of about 0.1 to 3% Ni at least sufficient to enhance the mechanical stability of retained austenite, the amount of nickel being also at least sufficient to counteract the destabilizing effect of Si on austenite.

A further embodiment of the invention resides in a method of producing fine grained low alloy, low to medium carbon silicon-containing steel casting consisting essentially of an Fe/Cr/C/Cu/Ni steel to which small but effective amounts of Al, Ti and Nb are added sufficient to provide fine grained steel following rapid cooling from the austenitizing temperature.

A still further embodiment of the invention is directed to a fine grained high strength low alloy, low to medium carbon steel casting consisting essentially of Fe/Cr/C/Mn/Cu/Ni/Al/Ti/Nb and containing about 0.1 to 0.5% Si.

DETAILED DESCRIPTION OF THE INVENTION

Figure 1:
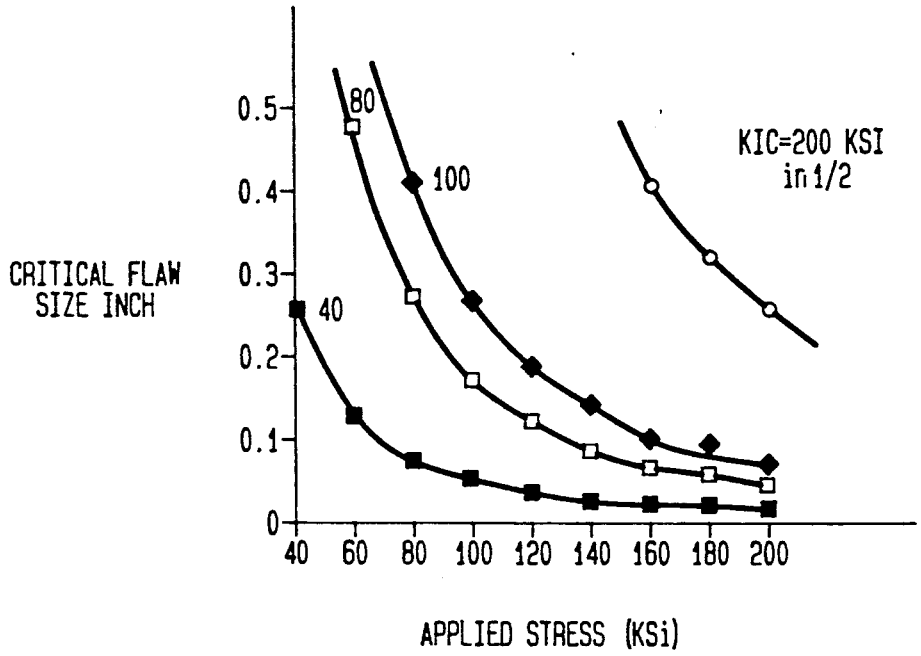

In accordance with a preferred embodiment of the invention, a class of high strength, high toughness low alloy steel castings of specified composition, cleanliness and microstructure are produced to integrate their mechanical property superiority with processing advantages, the cast steels being characterized, in addition, with a set of unique engineering property and practical performance advantages. The preferred compositions of the steels consist of principal alloying elements, microalloying, grain refining/weld HAZ toughness improvement additives and are produced to certain cleanliness standards by controlling the amount of residuals. The principal alloying elements include about 0.05 to 0.5 weight % carbon, about 0.5 to 4 weight percent chromium, about 0.1 to 0.5 Si, and about 0.5 to 2 weight % manganese. The preferred microalloying ingredients include copper and, more preferably, combined additions of copper and nickel for enhancing the stability of retained austenite. The preferred ranges for copper and nickel are about 0.1 to 2.0 weight % and about 0.1 to 3.0 weight %, respectively, the amount of nickel being also at least sufficient to counteract the destabilizing effect of Si on austenite. The grain refining/weld HAZ toughness improvement additions include at least two and preferably all three combined additions of the following elements: niobium, titanium and aluminum.

The preferred ranges for these elements are as follows: niobium, about 0.005 to 0.04 weight %; titanium, up to about 0.02 weight % and aluminum, about 0.01 to 0.05 weight %. In addition to these preferred ranges, the cast steels of the present invention require strict control as to cleanliness, level of residuals, and other undesirable alloying additions that are common in steel melting practice. For example, the cast steels of the present invention require that maximum limits be placed on the following more common residual elements in order that these cast steels develop the desirable microstructure and properties: sulfur levels not to exceed about 0.015 weight %, phosphorus levels not exceed about 0.02 weight %, soluble nitrogen not exceeding about 150 weight parts per million (ppm), but more preferably not exceeding 75 weight ppm.

The composition for the cast steels of the present invention are tabulated in weight % in Table I. Within these ranges, specific cast steels can be designed to obtain certain combination of mechanical properties or other engineering and technological properties.

TABLE I

CHEMISTRY RANGE FOR CAST STEELS OF PRESENT INVENTION

| | Range |
|---|---|
| Principal Alloying Elements | |
| C | 0.05–0.50 |
| Mn | 0.5–2.0 |
| Cr | 0.5–4.0 |
| Si | 0.1–0.5 |
| Microalloying | |
| Cu | 0.1–2.0 |
| Ni | 0.1–3.0 |
| Grain Refining/HAZ Toughness Improvement | |
| Nb | 0.005–0.04 |
| Ti | up to 0.02 |
| Al | 0.01–0.05 |
| Residuals | |
| S | <0.015 |
| P | <0.02 |
| N | <150 ppm |

A preferred chemistry of the cast steel of the invention to provide improved performance compared to AISI 43XX, AISI 41XX, and SAE 86XX is given in Table II below:

TABLE II

| Elements | % by Weight |
|---|---|
| C | 0.2–0.3 |
| Mn | 1.0–1.6 |
| Cr | 1.4–2.4 |
| Si | 0.2–0.4 |
| Cu | 0.35–0.5 |
| Ni | 0.3–1.0 |
| Nb | 0.005–0.04 |
| Ti | up to 0.02 |
| Al | 0.02–0.05 |
| S | <0.015 |
| P | <0.02 |
| N | <150 ppm |

The types of physical properties obtained with the cast steel of the invention is given in Table III as follows:

TABLE III

| Heat Treatment | Yield Strength (ksi) | Tensile Strength (ksi) | % Red. Area | % Elong |
|---|---|---|---|---|
| Standard | 184 | 220 | 10 | 5 |
| Modified | 169 | 207 | 11.2 | 4.5 |

In achieving the desired hardness and toughness in the cast steel of the invention, the steel is first homogenized and thereafter quenched from an austenitizing temperature ranging from about 870° C. to 1150° C., preferably about 900° C. to 1100° C. following the quench, the steel may be tempered at a temperature ranging from about 170° C. to 250° C., preferably from about 190° C. to 230° C. in accordance with known procedure.

In carrying out the heat treatment, the steel casting is first homogenized by heating it to a temperature of about 870° C. to 1150° C. for a time sufficient to substantially relieve the casting of segregation formed during the solidification of the casting. This is followed by cooling to room temperature, and the homogenized steel thereafter subjected to an austenitizing treatment by heating to a temperature of about 870° C. to 1150° C. and rapidly quenched to room temperature.

Another method is to homogenize the steel at a temperature of about 900° C. to 1150° C. for a time sufficient to substantially relieve the casting of segregation formed during solidification followed by furnace cooling to the lower temperature range of 870° C. to 1100° C. to austenitize the steel casting and then rapidly quenching said casting.

Preferably, the homogenizing temperature may range from about 950° C. to 1100° C. and the austenitizing temperature range from about 870° C. to 1000° C.

A more preferred treatment is to homogenize the casting at approximately 1065° C., followed by austenitizing at approximately 950° C.

A major feature of the invention is the use of a four pronged approach to impart unique microstructure and cleanliness to the steel: first, establish a frame work of fine prior austenite grain structure, with average grain diameter below about 200 microns, preferably below about 50 microns or ASTM grain size number in the range 8 to 11. Second, having achieved the fine grain size, the next feature is the provision of a microcomposite microstructure within these grains consisting of the major phase comprising dislocated lath martensite enveloped by a minor phase of retained austenite of optimized mechanical stability. The third part is concerned with the judicious control of unwanted tramp elements in the steel and the overall cleanliness of the steel in terms of the inclusion control. A fourth distinguishing feature of the current invention is the minor alloying additions to impart some special processing and engineering properties to the steel while not adversely affecting the other three aspects discussed above. The four aspects mentioned above are dramatic and significant and provide a total integrated concept which results in a unique class of high strength and tough steel castings. These four aspects of the present invention will be discussed in detail below.

(I) Fine Grained Structure: The chemistry of the present steels is designed so that they develop and maintain fine austenite grain size, around 200 or less, for a variety of heat-processing conditions. A well controlled addition of mixtures of Nb-Ti microalloying together with control of Al and N is needed to accomplish this goal. Nb-Ti coadditions will ensure negligible grain growth even at high reheat temperatures up to about 1100° C. and will result in fine recrystallized austenite grain size following thermomechanical processing of the wrought grades provided the (Nb,Ti) (C,N) particle size is controlled to $<0.1$ μm. During the development of the present invention, it became apparent that many foundry mills can not obtain the desired dispersion of the (Nb,Ti) (C,N) particles. Therefore, for the castings, a less effective and yet powerful single additions of Nb for grain refining is specified for those foundries where lack of metal superheat control critically affects the size of the carbonitrides needed for grain refining. A key aspect of the Nb-Ti additions in the present steel is to control these additions in such a way as to exploit their beneficial effects on grain refining while controlling the maximum amounts to a level where their harmful side effects in precipitation hardening and weld Heat-Affected-Zone (HAZ) toughness are substantially minimized.

(II) Microcomposite Microstructure: The steels of the present invention are designed to produce a microcomposite microstructure consisting of soft and tough retained austenite films (minor phase) surrounding strong dislocated lath martensite (major phase). This base microstructure is established within a framework of ultrafine prior austenite grains by choosing C-Mn-Cr alloying. It has been shown that at the same strength level, dislocated lath martensite is considerably tougher than the twinned plate/lath martensite in carbon bearing structural steels. It has also been widely discussed in the literature that thin, continuous films of retained austenite comprising less than about 5 to 6 volume % could promote the toughness of the composite structure substantially provided they are characterized by optimized mechanical stability. The C-Mn-Cr base chemistry while establishing the desired base microstructure is found to be inadequate in optimizing the mechanical stability of the retained austenite leading to premature stress/strain induced transformation upon mechanical loading. Therefore, alloying and/or processing modifications have to be devised to impart the necessary mechanical stability to this austenite while not altering the desired dislocated substructure of the martensite phase. This goal has been found to be achievable through microalloy additions of copper (Cu). It should be pointed out that it is well known that Cu additions in steel should be done in conjunction with suitable Ni additions in order to overcome the deleterious effects of Cu on "hot shortness" of steel. Notwithstanding this, some Ni is preferred in the present cast grade to enhance the low temperature toughness properties which is a prime requirement for several casting applications as summarized in the beginning. Furthermore, Ni enhances the amount and stability of the retained austenite. The Ni also counteracts the destabilizing effect of Si on austenite. Thus the present steels are medium carbons steels (0.1 to 0.5 weight % C) with a base alloying of Mn-Cr and microalloying of Cu-Ni with grain refiners Nb-Ti. The total alloying in the steel need not exceed about 6 weight %.

(III) Tramp Element and Inclusion Control: Impurities and inclusions introduced during steel making process can critically degrade the toughness properties of the cast as well as wrought products. Silicon, a common alloying element and deoxidizer in structural steels, is actually an unwanted impurity which contributes to the destabilization of retained austenite in the present steels. Thus, for the wrought grade Si is restricted to less than about 0.1 weight %. However, since Si is known to enhance the fluidity of the steels, a prime requirement to the casting soundness, for the cast grade, this restriction is relaxed to an upper limit of about 0.5 weight %. In the present steels it has been found that high Si can also have adverse HAZ toughness. Thus, it is preferable that even for cast grade that Si be as low as possible, preferably $\leqq 0.3$ weight %. Sulfur and phosphorus, either by precipitating out in the form of harmful inclusions or staying in solid solution and segregating at interfaces, can degrade the upper shelf energy besides increasing the ductile-to-brittle transition temperature (DBTT). High S can also lead to strong directionality in properties in wrought products. For the cast grades S is limited to less than 0.015 weight %. All the other residual tramp elements including antimony, arsenic, lead, etc. should be as low as practically feasible.

Gases such as nitrogen, oxygen and hydrogen either dissolved or precipitated in the steel also can degrade steel's mechanical properties. However, some nitrogen can actually be desirable if precipitated out in the form of stable carbonitrides for grain refining as alluded to above. However, unstabilized or free nitrogen dissolved in steel has been found to be detrimental to the toughness both in base steel as well as in the weld HAZ. For this reason an upper limit of 150 ppm is specified for soluble nitrogen for the present steels. In order to meet the strict cleanness standards for the steels of the present invention, it is desirable that the steels are refined following conventional melting before the steel is poured in the moulds.

(IV) Microalloying for Processing Flexibility and Property advantage: The Ti-Nb co-additions are advantageous in restraining HAZ grain coarsening during high heat-input welding. Cu-Ni microalloying is found to be by far the most desirable alloying from the point of minimizing the adverse effects of any alloying in lowering the HAZ toughness brought about by their effect on increasing the hardenability and/or promotion of injurious, needle type precipitates. The required copper additions of the present steels are desirable for high atmospheric and sour environment corrosion resistance. This in turn lowers the severity of damage processes associated with introduction into steel of hydrogen, a dangerous by-product of corrosion in high strength steels. Therefore, the resistance to Hydrogen-Induced-Cracking (HIC) and Hydrogen-Assisted-Cracking (HAC) of the present steels is anticipated to be superior. The latter process is the primary mechanism of many stress corrosion cracking processes in high strength steels.

It would be helpful at this point to explain certain terms applicable to austenite and its transformation characteristics. Those familiar with the field have used a variety of technical terms to describe the transformation characteristics of austenite. Insofar as the present invention is concerned, the following technical terms will be used.

Stabilization of austenite refers to the processes and mechanisms responsible for retaining the high temperature austenite phase in the metastable condition at ambient. Stability of austenite is that property of retained austenite to transform when subjected to thermal ageing and/or mechanical deformation.

In the context of the above terminology, thermal stabilization refers to thermal processes, seen as carbon and nitrogen diffusion and precipitation effects, which lead to the retention of austenite when quenched from a high temperature.

Mechanical Stabilization refers to the retention of austenite during quenching from a high temperature to accommodate volume expansion which occurs when a major portion of austenite transforms to martensite.

Thermal Stability refers to the stability of retained austenite to transformation when subjected to thermal ageing. Mechanical Stability refers to the stability of retained austenite to transformation when subjected to mechanical deformation.

Examples of specific compositions are tabulated as Heat 1 and Heat 2 in Table IV as follows:

TABLE IV

| | Heat 1 | Heat 2 |
|---|---|---|
| C | 0.241 | 0.208 |
| Mn | 1.4 | 1.53 |
| Cr | 1.77 | 1.83 |
| Cu | 0.398 | 0.398 |
| Ni | 0.86 | 0.85 |
| Cb | 0.033 | 0.03 |
| Al | 0.084 | 0.06 |
| N | 0.0052 | 0.0031 |
| Si | 0.3 | 0.16 |
| P | 0.029 | 0.021 |
| S | 0.006 | 0.008 |
| Mo | 0.06 | 0.01 |

EXPERIMENTAL

Casting test blocks were produced by air induction melting followed by refining in a Argon-Oxygen-Decarburizer. The cast test blocks were subjected to two types of heat-treatment: the standard heat-treatment consisted of 1950° F. (1065° C.) homogenization for 2 hours followed by fan cooling to ambient and austenitizing at 1650° F. (900° C.) for 1 hour followed immediately by a water quench. The modified heat-treatment involved 1950° F. (1065° C.) homogenization as above but followed by furnace cooling to 1750° F. (955° C.) and water quenching. For the standard and modified heat-treatments both as quenched and quenched and tempered conditions were characterized. The tempering treatment consisted of 400° F. (205° C.) holding for 2 hours followed by cooling to ambient. Other types of initial homogenization treatments including 1750° F. (955° C.) have been studied and can be used depending on the limitations of particular foundry to heat-treat at a higher temperature. Similarly tempering temperatures of up to about 482° F. (250° C.) can be used depending on the strength-toughness requirements of a particular casting.

In summary, the invention provides a high strength, low alloy, low to medium carbon steel for castings consisting essentially of about 0.5 to 4% Cr, about 0.05 to 0.5% C, about 0.5 to 2% Mn, about 0.1 to 0.5% Si, about 0.1 to 2% Cu, 0.1 to 3% Ni, about 0.01 to 0.05% Al, up to about 0.02% Ti, and about 0.005 to 0.03% Nb.

The results obtained on Heats 1 and 2 with respect to Charpy-V-Notch impact toughness is given in Table V below:

TABLE V

| Heat/Heat-Treatment | at Room Temp. | at −40° C. | Hardness BTTM |
|---|---|---|---|
| Heat 1 | | | |
| 955° C. As-quenched | 20.3/27.5 (23, 19, 19) | 12.5/17.0 | |
| 955° C. Hom. Std | 25/33.9 (28, 24, 23) | 13.3/18.0 (17, 13, 10) | 430 |
| 1065° C. As-Quenched | 18.3/24.8 (15, 22, 18) | 13.6/18.4 (15, 10, 16) | |
| 1065° C. Hom. Std | 27.3/37.0 (28, 26, 28) | 19.3/26.2 (21, 22, 15) | 460 |
| Heat 2 | | | |
| 1065° C. Hom. Std | | 18.0/24.4 (17, 19, 18) | 430 |
| 1065° C. As-quenched | | 12.7/17.2 (13, 13, 12) | |
| 1065° C. Interr. Q&T | 39.6/53.7 (38, 39, 42) | 24.7/33.4 (23, 24, 27) | 430 |
| 1065° C. Interr. As-quenched | 37.3/50.6 (37, 37, 38) | 20.0/27.1 (24, 23, 13) | 429 |

Individual Charpy Values in ft-lbs in brackets, average value on first row in ft. lbs/joules

HEAT-TREATMENT KEY

955° C. Hom. Std.: 955° C./2 hrs.; Fan Air Cool, 900° C./2 hrs. Water Quench; 205° C./2 hrs. temper 955° C As-Quenched: Same as above but no temper 1065° C. Std. Hom.: 1065° C./2 hrs.: Fan Air Cool, 900° C./1 hr. water quench; 205° C./2 hrs. temper 1065° C. As-quenched: Same as above but no temper 1065° C. interr. Q&T: 1065° C./2 hrs. furnace cool to 955° C., water quench, 205° C./2 hrs. temper.

Figure 2:
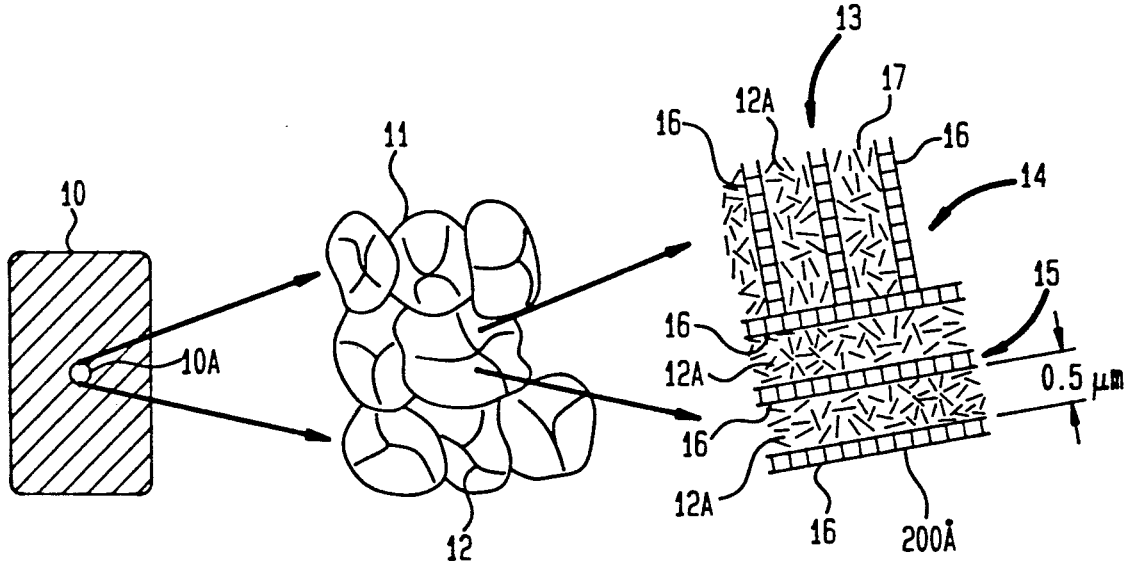

One of the advantages of the present invention is the production of a microcomposite microstructure consisting of soft and tough retained austenite (minor phase) surrounding strong dislocated lath martensite (major phase). This is shown in the schematic of FIG. 2 which depicts a cross section of a steel bar casting 10 from which a sample 10A is removed and examined metallographically at about 200 times magnification to show equiaxed grains 11, which reveal packets of lath martensite 12 shown more clearly in the idealized microcomposite microstructure indicated generally by the numeral 13, the microstructure at about 60,000 times magnification comprising packets 14 and 15 of the lath martenite/austenite structure.

The packets are made up of films of retained austenite 16 sandwiching therebetween dislocated lath martensite 12A having dispersed therethrough fine carbide particles 17. As shown in FIG. 2, the films of retained austenite are about 200 Angstroms thick (A) and are separated from each other by a distance of about 0.5 micron. This idealized microstructure accounts for the high strength and toughness of the cast steel of the invention.

Although the present invention has been described in conjunction with the preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A method for enhancing the mechanical properties of a high strength, low alloy, low to medium carbon steel casting of the Fe/Cr/C type which comprises, adding to said steel in the molten state containing by weight about 0.1 to 0.5% Si, a small but effective amount of copper sufficient to enhance the mechanical stability of retained austenite formed following quenching of said steel casting from its austenitizing temperature but not exceeding that amount of Cu to over-stabilize said retained austenite, and also an amount of Ni in the range of about 0.1 to 3.0% sufficient to counteract the destabilizing effect of Si on austenite and to enhance the mechanical stability of said retained austenite, whereby the steel has a microstructure comprising a major phase comprising lathe martensite enveloped by a minor phase of retained austenite.

2. The method of claim 1, wherein the low alloy, low to medium carbon Fe/Cr/C Steel casting contains by weight about 0.5 to 4% Cr, and about 0.05 to 0.5% carbon.

3. A method for enhancing the mechanical properties of a high strength, low alloy low to medium carbon steel casting of the Fe/Cr/C type which comprises:

adding to said steel in the molten state and containing by weight about 0.1 to 0.5% Si, an effective amount of copper sufficient to enhance the mechanical stability of retained austenite formed following quenching of said steel casting from its austenitizing temperature but not exceeding that amount of Cu to over-stabilize said retained austenite, and an amount of Ni in the range of about 0.1 to 3.0% sufficient to counteract the destabilizing effect of Si on retained austenite;

casting said steel;

quenching said steel casting from its austenitizing temperature whereby the steel has a microstructure comprising a major phase of lath martensite enveloped by a minor phase of retained austenite.

4. In a high strength, low alloy, low to medium carbon steel casting of the Fe/Cr/C type containing about 0.1 to 0.5% Si and characterized by the presence of retained austenite when quenched from its austenitizing temperature, wherein the improvement is characterized by said steel containing an effective amount of copper sufficient to enhance the mechanical stability of retained austenite but not exceeding that amount of Cu to over-stabilize said retained austenite, and an amount of Ni in the range of about 0.1 to 3.0% sufficient to counteract the destabilizing effect of Si on retained austenite, and the steel having a microstructure comprising a major phase of lath martensite enveloped by a minor phase of retained austenite.

5. A high strength, tough, low alloy, low to medium carbon steel casting, said steel casting comprising of about 0.5% to 4% Cr, about 0.05 to 0.5% C, about 0.1 to 0.5% Si, about 0.1 to 2% Cu and about 0.1 to 3% Ni and the balance being iron, the steel having and said Ni being present in an amount sufficient to counteract the destabilizing effect of Si on retained austenite and the amount of retained austenite ranges from 1 to 10 volume percent, and the steel having a microstructure comprising a major phase of lath martensite enveloped by a minor phase of retained austenite.

6. The casting as recited in claim 5 having a fine grain and a tensile strength of at least about 200 ksi.

* * * * *